US006526932B1

(12) United States Patent
Sarhan et al.

(10) Patent No.: US 6,526,932 B1
(45) Date of Patent: Mar. 4, 2003

(54) COMBINATION INTAKE AND EXHAUST VALVE ASSEMBLY

(75) Inventors: Marwan A. Sarhan, Dammam (SA); Shehadi G. Harb, Tallmadge, OH (US); Nahed F. Farah, Akron, OH (US)

(73) Assignee: MNS Limited, LLC, Tallmadge, OH (US)

( * ) Notice: Subject to any disclaimer, the term of this patent is extended or adjusted under 35 U.S.C. 154(b) by 0 days.

(21) Appl. No.: 09/875,664

(22) Filed: Jun. 6, 2001

(51) Int. Cl.[7] ..... F01L 1/28
(52) U.S. Cl. ..... 123/188.4
(58) Field of Search ..... 123/188.4, 85

(56) References Cited

U.S. PATENT DOCUMENTS

| | | | | |
|---|---|---|---|---|
| 4,020,803 A | | 5/1977 | Thuren et al. | 123/32 VN |
| 4,624,222 A | | 11/1986 | Yoshikawa | 123/90.27 |
| 4,957,073 A | * | 9/1990 | Bergeron | 123/79 C |
| 5,081,965 A | | 1/1992 | Walters et al. | 123/188 AA |
| 5,165,445 A | | 11/1992 | Vertanen | 137/493.6 |
| 5,197,428 A | | 3/1993 | Hornby | 123/296 |
| 5,301,504 A | | 4/1994 | Bertling et al. | 60/307 |
| 5,390,697 A | | 2/1995 | Muschelknautz | 137/494 |
| 5,479,889 A | | 1/1996 | Sato et al. | 123/308 |
| 5,479,978 A | | 1/1996 | Zenkich | 137/493.3 |
| 5,749,336 A | | 5/1998 | Tamaki et al. | 123/337 |
| 5,803,115 A | | 9/1998 | Vertanen et al. | 137/493.9 |
| 5,899,270 A | | 5/1999 | Watson | 16/105.5 |
| 5,946,906 A | | 9/1999 | Akazaki et al. | |

FOREIGN PATENT DOCUMENTS

DE 3725049 A1 * 8/1988 ..... F01L/1/28

* cited by examiner

*Primary Examiner*—Gene Mancene
*Assistant Examiner*—Hyder Ali
(74) *Attorney, Agent, or Firm*—Eschweiler & Associates, LLC

(57) ABSTRACT

An internal combustion engine includes a combination intake and exhaust valve assembly. The combination intake and exhaust valve assembly includes an intake valve and an exhaust valve which are disposed in a coaxial relationship. The intake valve has an annular rim portion which is movable into and out of engagement with an intake valve seat. The exhaust valve has a head end portion with an annular rim which is movable into and out of engagement with a valve seat disposed on the intake valve. When the intake valve is operated from a closed position to an open position, the intake and exhaust valves move together. A pair of rocker arms may be used to move the intake valve from its closed position to its open position. A single rocker arm may be used to move the exhaust valve from its closed position to its open position.

24 Claims, 5 Drawing Sheets

COMBINATION INTAKE AND EXHAUST VALVE ASSEMBLY

BACKGROUND OF THE INVENTION

The present invention relates to intake and exhaust valves for an internal combustion engine.

Known internal combustion engines of either the diesel or the spark ignition type include one or more intake valves which control the flow of an air fuel mixture to a combustion chamber of the engine. One or more exhaust valves are utilized to control the flow of exhaust gases from the combustion chamber of the engine. The power of the engine has previously been limited by the amount of the air which can be drawn into the engine during an intake stroke. If the size of the intake valve is increased, the amount of the air which can be drawn into the combustion chamber is increased. Because exhaust gases are pumped out of the engine by the movement of the piston in the cylinder, the size of the exhaust valve is usually not a limiting factor in the power which can be created by an engine.

In order to increase the amount of the air which is drawn into the engine during an intake stroke, internal combustion engines have been designed with two intake valves for each cylinder chamber. Although the use of two intake valves increases the amount of the air which can be drawn into the combustion chamber, the overall size of the two intake valves is limited by the cylinder head space required for the two intake valve openings and by the cylinder head space required for one or more exhaust valve openings. Of course, the use of two intake valves increases the number of components required in an engine and the cost of the engine.

SUMMARY OF THE INVENTION

The present invention relates to a new and improved is combination intake and exhaust valve assembly which is used in an internal combustion engine. The combination intake and exhaust valve assembly includes an intake valve and an exhaust valve which are disposed in a coaxial relationship. A valve seat for a head end portion of the intake valve is disposed on the cylinder head. A valve seat for the exhaust valve is disposed on the intake valve.

When the intake valve is operated from a closed condition to an open condition, the intake and exhaust valves may be moved together. However, the exhaust valve remains in a closed condition. If desired, the exhaust valve could be moved toward the closed condition as the intake valve moves toward the open condition. The intake valve is subsequently moved from the open condition to the closed condition while the exhaust valve remains in a closed condition and moves with the intake valve. If desired, the exhaust valve could be moved toward the open condition as the intake valve moves toward the closed condition.

After an air fuel mixture has been burned in the combustion chamber, the exhaust valve is moved to the open condition. As the exhaust valve begins to move toward the open condition, a head end portion of the exhaust valve moves away from a valve seat disposed on the intake valve. Guides for movement of the exhaust valve relative to the intake valve may be mounted on the intake valve.

The present invention includes a plurality of features which may be used separately or in combination with each other. Combinations of features which are different than the combinations described herein may be used.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

Figure 1:
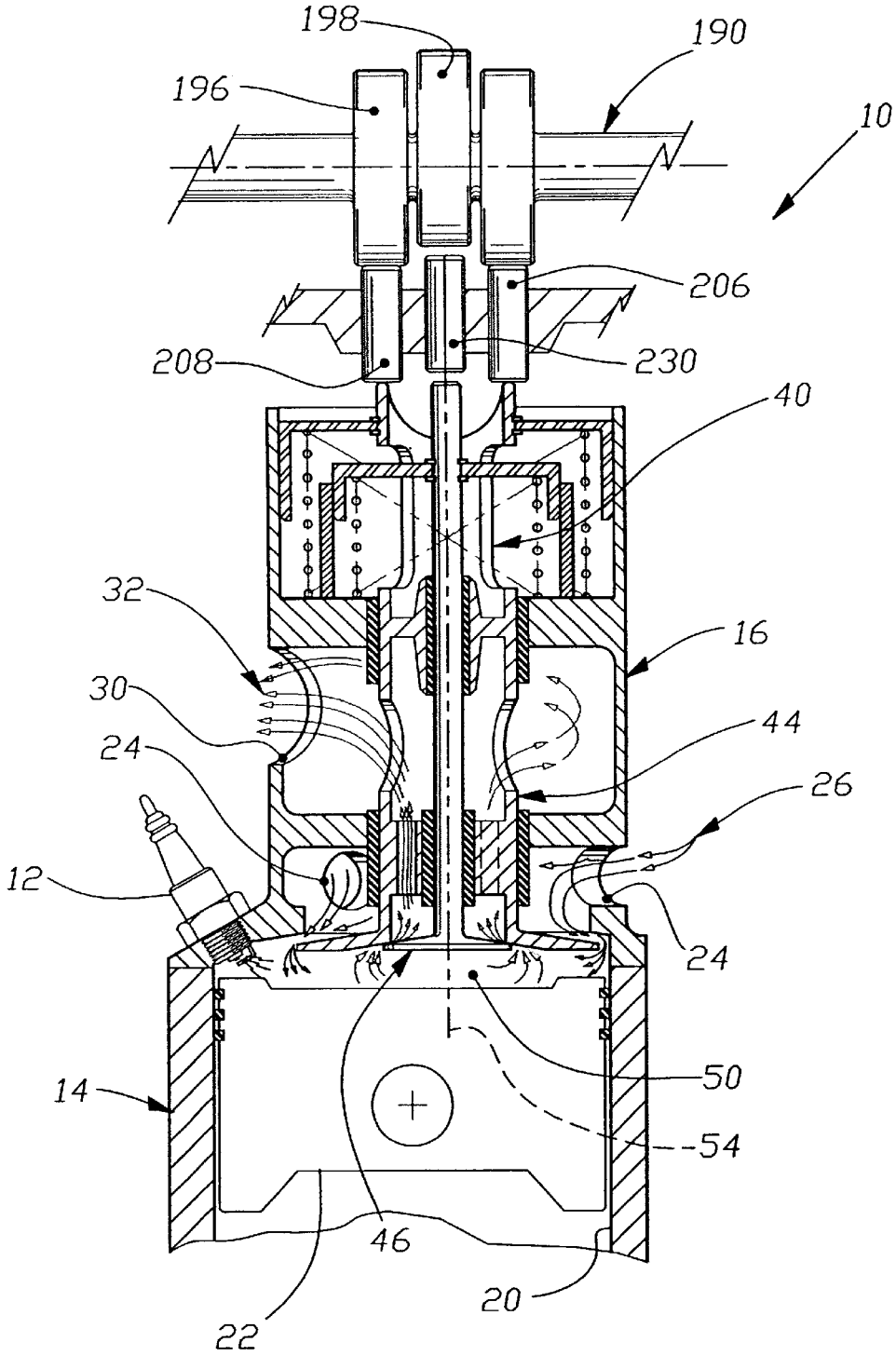
FIG. 1 is a fragmentary sectional view schematically illustrating the relationship of a combination intake and exhaust valve assembly to a cylinder head of an engine.

An engine 10 is illustrated schematically in FIG. 1. The engine 10 is of the spark ignition type and therefore has a spark plug 12 to ignite an air fuel mixture. However, the engine 10 could be of the diesel type if desired. If the engine 10 was of the diesel type, the spark plug 12 would be omitted.

The engine 10 includes a cylinder block 14 and a cylinder head 16 which is fixedly secured to the cylinder block. The cylinder block 14 defines a cylinder 20 in which a cylindrical piston 22 reciprocates during operation of the engine. The cylinder head 16 is provided with intake ports 24 through which an air fuel mixture, indicated schematically as 26 in FIG. 1, enters the cylinder head 16. Of course, if fuel is injected directly into the cylinder 20, only air would be drawn in through the intake ports 24. In addition, the cylinder head 16 includes an exhaust port 30 through which exhaust gases, indicated schematically by arrows 32 in FIG. 1, are discharged from the cylinder head 16.

In accordance with one of the features of the present invention, a combination intake and exhaust valve assembly 40 is provided in the cylinder head 16. The combination intake and exhaust valve assembly 40 includes an intake valve 44 and an exhaust valve 46. The intake valve 44 controls a flow of fluid which may be the air fuel mixture 26 or, in some engines, may be just air, through the intake port 24 into a combustion chamber 50 formed between the piston 22, cylinder head 16 and the upper end portion of the cylinder block 14. The exhaust valve 46 controls the flow of fluid, which is exhaust gases 32, from the combustion chamber 50 through the exhaust port 30.

Figure 2:
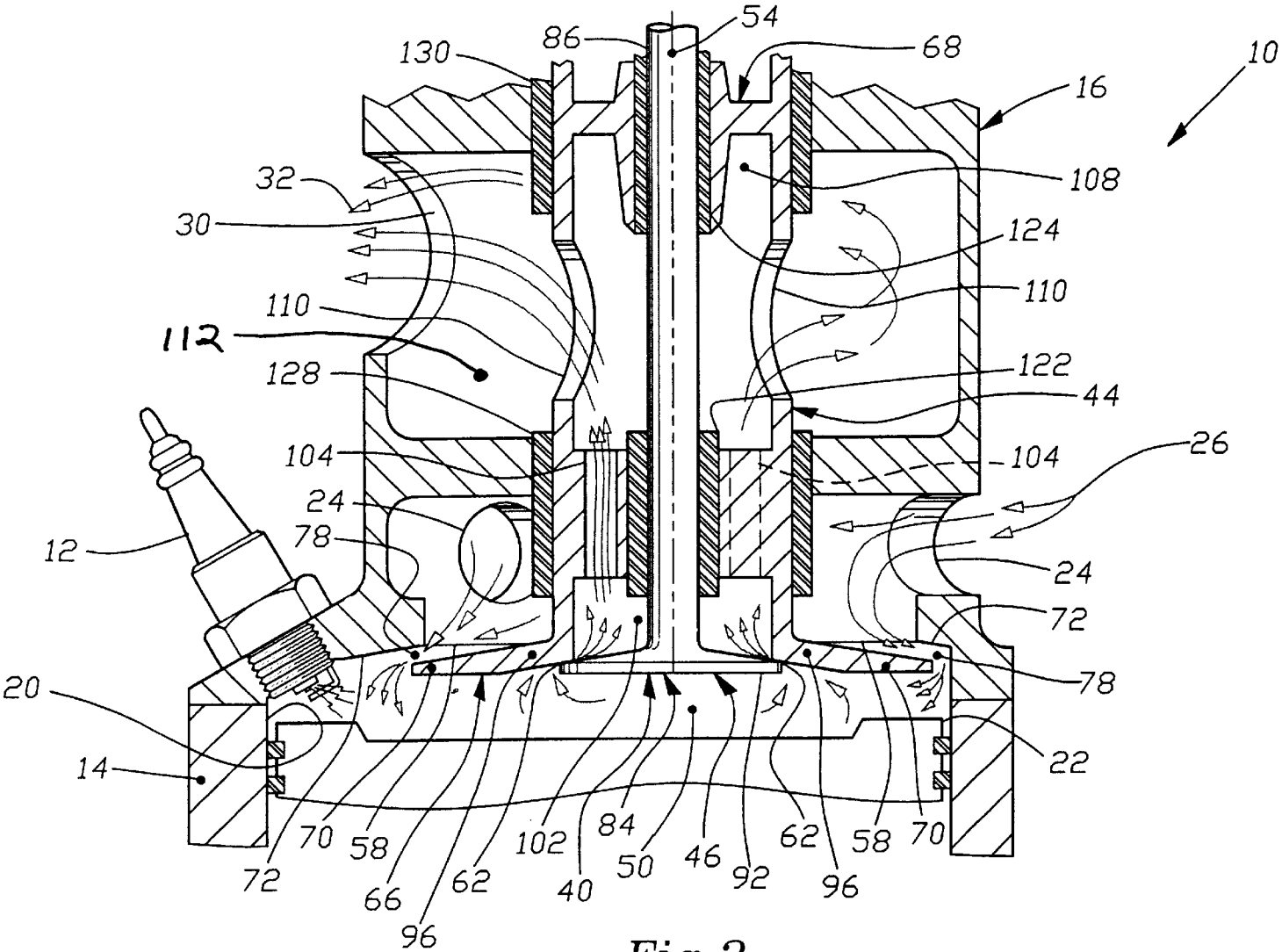
FIG. 2 is an enlarged fragmentary view of a portion of FIG. 1 and schematically illustrating the relationship of a head end portion of an open intake valve to a valve seat disposed on the cylinder head of the engine and the relationship of a head end portion of a closed exhaust valve to a valve seat disposed on the intake valve.

The intake valve 44 and exhaust valve 46 are disposed in a coaxial relationship. Thus, the intake valve 44 and exhaust valve 46 have a common central axis 54 (FIGS. 1 and 2). The intake valve 44 is axially movable along the axis 54 between a closed condition blocking the flow of gas through an inlet port 58 and an open condition, illustrated in FIG. 2, enabling the air fuel mixture 26 to flow through the inlet port. Similarly, the exhaust valve 46 is operable between a closed condition blocking the flow of gas through an outlet port 62 in the manner illustrated in FIG. 2 and an open condition enabling exhaust gases to flow through the outlet port 62.

The intake valve 44 includes a circular head end portion 66 and a cylindrical stem portion 68 (FIG. 2). The head end portion 66 and stem portion 68 have a common central axis 54 and are fixedly connected with each other. However, if desired, the central axis of the stem potion 68 could be offset from the central axis of the head end portion 66.

The head end portion 66 (FIG. 2) of the intake valve 44 includes an annular rim portion 70 which is engagable with an annular valve seat 72. In the illustrated embodiment of the invention, the valve seat 72 is integrally formed as one piece with the cylinder head 16. However, if desired, the valve seat 72 could be formed by an annular ring which is mounted on the cylinder head 16.

When the intake valve 44 is in the closed condition, the rim portion 70 on the head end portion 66 of the intake valve is disposed in sealing engagement with the valve seat 72 disposed on the cylinder head 66. When the intake valve 44 is in the open condition, illustrated in FIG. 2, the rim portion 70 on the head end portion 66 of the intake valve is spaced from the valve seat 72. The intake valve 44 reciprocates between the open and closed conditions along the axis 54.

In accordance with one of the features of the invention, the annular rim portion 70 (FIG. 2) of the intake valve 44 has a relatively large diameter. This results in a relatively large annular opening 78 being formed between the rim portion 70 of the intake valve 44 and the valve seat 72. The relatively large area of the opening 78 is achieved even though the intake valve 44 moves through a relatively small distance along the axis 54.

The large area of the annular opening 78 facilitates flow of the air fuel mixture 26 into the combustion chamber 50 when the intake valve 44 is in the open condition of FIG. 2. Thus, even though the annular opening 78 has a relatively short vertical (as viewed in FIG. 2) extent, the large diameter of the opening results in the opening having a relatively large area. The relatively large area of the opening 78 promotes efficient operation of the engine 10 since air or an air fuel mixture 26 can easily be drawn into the combustion chamber 50 by suction created during downward (as viewed in FIG. 2) movement of the piston 22 with the intake valve 44 in the open condition.

The exhaust valve 46 (FIG. 2) has a circular head end portion 84 and a cylindrical stem portion 86. The cylindrical stem portion 86 extends along the center of the stem portion 68 of the intake valve 44. In the illustrated embodiment of the invention, the exhaust valve stem portion 86 has a central axis which is coincident with the central axis 54 of the combination intake and exhaust valve assembly 40. However, it is contemplated that the coincident central axes of the intake valve stem portion 68 and exhaust valve stem portion 86 could be offset from the central axis of the head end portion 66 of the intake valve 44 if desired.

During movement of the intake valve 44 between the open and closed conditions, the exhaust valve 46 remains in the closed condition illustrated in FIG. 2. The closed exhaust valve 46 moves with the intake valve 44 as the intake valve moves between the open and closed conditions.

When the intake valve 44 is in the closed condition, the exhaust valve 46 is axially moved relative to the intake valve between open and closed conditions. Thus, the exhaust valve 46 moves with the intake valve 44 during operation of the intake valve between the open and closed conditions while the exhaust valve remains in the closed condition illustrated in FIG. 2. However, during movement of the exhaust valve 46 between its open and closed conditions, the intake valve 44 remains stationary in the closed condition. It should be understood that there may be some overlapping of operation of the intake valve 44 and exhaust valve 46 between their open and closed conditions so that, as the intake valve 44 is opening, the exhaust valve 46 may not be completely closed.

The head end portion 84 of the exhaust valve 46 includes an annular rim portion 92 which is coaxial with the annular rim portion 70 of the intake valve 44. The rim portion 92 of the exhaust valve 46 is engagable with an annular valve seat 96 formed on the head end portion 66 of the intake valve 44. Although the intake valve rim portion 70, intake valve seat 72, exhaust valve rim portion 92 and exhaust valve seat 96 are all disposed in a coaxial relationship, it is contemplated that they could be disposed in a different relationship if desired.

When the exhaust valve 46 is in the closed condition of FIG. 2, the annular rim portion 92 on the circular head end portion 84 of the exhaust valve 46 sealingly engages the annular valve seat 96 on the intake valve 44 to block the flow of gas from the combustion chamber 50. When the exhaust valve 46 is in the open condition, the rim portion 92 of the exhaust valve is spaced from the valve seat 96. When the exhaust valve 46 is in the open condition, exhaust gases can flow from the combustion chamber 50 through an annular opening formed between the head end portion 84 of the exhaust valve 46 and the head end portion 66 of the intake valve 44.

In accordance with another feature of the present invention, the exhaust gases are conducted through cavities and/or passages formed in the intake valve 44. The intake valve 44 includes a cylindrical recess 102 formed in the head end portion 66 and the stem portion 68 of the intake valve 44. The recess 102 is open to the combustion chamber 50 through the annular space between the exhaust valve seat 96 and the rim portion 92 of the exhaust valve 46 when the exhaust valve is in the open condition. The recess 102 has a central axis which is coincident with the axis 54.

When the exhaust valve 46 is in the open condition, exhaust gases 32 flow from the recess 102 through a plurality of cylindrical passages 104 (FIG. 2) formed in the stem portion 68 of the intake valve 44. The passages 104 extend parallel to the axis 54 and are disposed in a circular array about the axis 54. Although only two passages 104 are shown in FIG. 2, it should be understood that there may be any suitable number of passages. For example, there may be six passages 104 formed in the stem portion 68 of the intake valve 44.

The exhaust gases flow from the passages 104 into a relatively large cylindrical recess 108 formed in the stem portion 68 of the intake valve 44. The cylindrical recess 108 has a central axis which is coincident with the axis 54. The cylindrical recess 108 has an inside diameter which is greater than the outside diameter of the circular array of passages 104. The inside diameter of the cylindrical recess 108 is approximately the same as the inside diameter of the recess 102. The cylindrical recess 108 has an axial extent which is substantially greater than the axial extent of the recess 102.

The exhaust gases flow from the recess 108 through a, plurality of circular openings 110 into a cylindrical head exhaust chamber 112 through which the stem portion 68 of the intake valve 44 extends. The circular openings 110 have coincident central axes extending perpendicular to the axis 54. The combined cross sectional area of the openings 110 can be greater than the cross sectional area of the recess 108. The exhaust gases flow from the exhaust chamber 112 through an exhaust port 30.

The exhaust valve stem portion 86 extends through the recesses 102 and 108 formed in the stem portion 68 of 1the intake valve 44. Cylindrical valve guides 122 and 124 (FIG. 2) guide movement of the exhaust valve 46 between the open and closed conditions. The exhaust valve guides 122 and 124 are mounted on and are coaxial with the stem portion 68 of the intake valve 44. The valve guides 122 and 124 engage the cylindrical stem portion 86 of the exhaust valve 46 to guide movement of the exhaust valve.

Similarly, cylindrical valve guides 128 and 130 are mounted on the cylinder head 16 to guide movement of intake valve 44. The intake valve guides 128 and 130 are coaxial with the exhaust valve guides 122 and 124 and the exhaust valve stem portion 68. If desired, the exhaust valve guides 128 and 130 could be omitted and surfaces on the cylinder head 16 could be utilized to guide movement of the intake valve 44. Similarly, the exhaust valve guides 122 and 124 could be omitted and surfaces on the stem portion 68 of the intake valve 44 could be utilized to guide movement of the exhaust valve 46.

Valve Actuation Apparatus

A valve actuation apparatus 140 (FIGS. 3 and 4) effects operation of the intake valve 44 and exhaust valve 46 between their open and closed conditions. The valve actuation apparatus 140 includes a valve closing spring system 144 (FIG. 3) which is effective to urge the intake valve 44 and the exhaust valve 46 to their closed conditions. In addition, the valve actuation apparatus 140 includes a valve operating assembly 148 (FIG. 4) which effects operation of the intake valve 44 and exhaust valve 46 from their closed conditions to their open conditions against the influence of the valve closing spring system 144 (FIG. 3).

Figure 3:
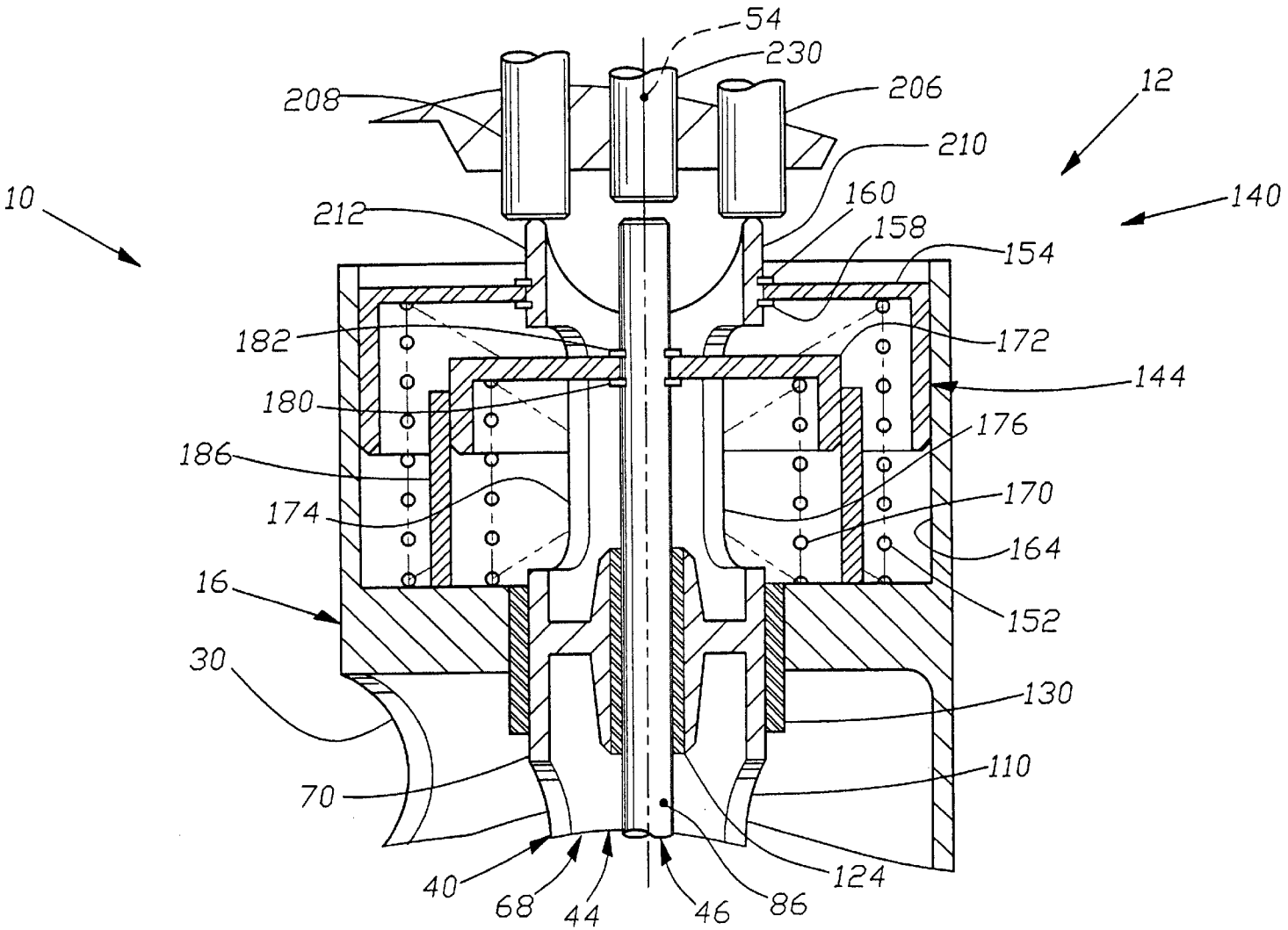
FIG. 3 is an enlarged fragmentary sectional view of a portion of FIG. 1 and illustrating the relationship of return springs to stem portions of the intake and exhaust valves.

The valve closing spring system 144 includes a helical coil intake valve spring 152 which engages a cylindrical spring retainer 154 (FIG. 3). The spring retainer 154 is connected with an upper end portion of the intake valve 44. Thus, the spring retainer 154 is connected to the stem portion 68 of the intake valve 44 by circular clips 158 and 160. The clips 158 and 160 extend into annular grooves which extend around the stem portion 68 of the intake valve 44. The spring 152 and spring retainer-154 are disposed in a coaxial relationship with the stem portion 68 of the intake valve 44.

The spring 152 is maintained in a compressed condition by the spring retainer 154. Therefore, there is always a biasing force applied against the spring retainer 154 urging the intake valve 44 toward is closed condition. The spring retainer 154 slidably engages a cylindrical guide surface 164 formed on the cylinder head 16.

When the intake valve 44 is operated to the open condition, the spring retainer 154 is forced downward along the guide surface 164 to the position illustrated in FIG. 3. Downward movement of the spring retainer 154, to the position illustrated in FIG. 3, compresses the spring 152 as the intake valve 44 is operated from its closed condition to its open condition. When the intake valve 44 is to be operated from the open condition back to the closed condition, the intake valve is released and the spring 152 moves the spring retainer 154 and valve stem 68 upward (as viewed in FIG. 3) to close the intake valve. The spring 152 and spring retainer 154 are effective to apply force against the closed intake valve 44 to firmly seal the intake valve against the valve seat 72 (FIG. 2).

The valve closing spring system 144 also includes a helical coil exhaust valve spring 170 (FIG. 3). The exhaust valve spring 170 is constantly maintained in a compressed condition by engagement with a spring retainer 172. The spring retainer 172 has a generally rectangular configuration and extends through generally rectangular openings 174 and 176 formed in the stem portion 68 of the intake valve 44. The spring retainer 172 is connected with the stem portion 86 of the exhaust valve 46 by circular clips 180 and 182.

The exhaust valve spring 170 is effective to constantly urge the exhaust valve 46 toward the closed condition of FIG. 2. The exhaust valve spring 170 is circumscribed by and is coaxial with the intake valve spring 152 and the stem portion 86 of the exhaust valve 46.

When the exhaust valve 46 is to be operated from the closed condition to the open condition, the exhaust valve stem portion 86 is moved downward (as viewed in FIG. 3) relative to the intake valve stem portion 68. A cylindrical guide wall 186 is slidably engaged by the spring retainer 172 to guide movement of the spring retainer. As the spring retainer 172 moves downward (as viewed in FIG. 3) the exhaust valve spring 170 is further compressed.

When the exhaust 46 is to be operated from the open condition to the closed condition, the exhaust valve is released. The spring retainer 172 is then moved upward along the cylindrical guide wall 186 by the spring 170. This moves the exhaust valve 46 upward to close the exhaust valve. The spring 170 and spring retainer 172 are effective to apply force against the closed exhaust valve 46 to firmly seal the exhaust valve against the valve seat 96 on the intake valve 44 (FIG. 2).

Figure 4:
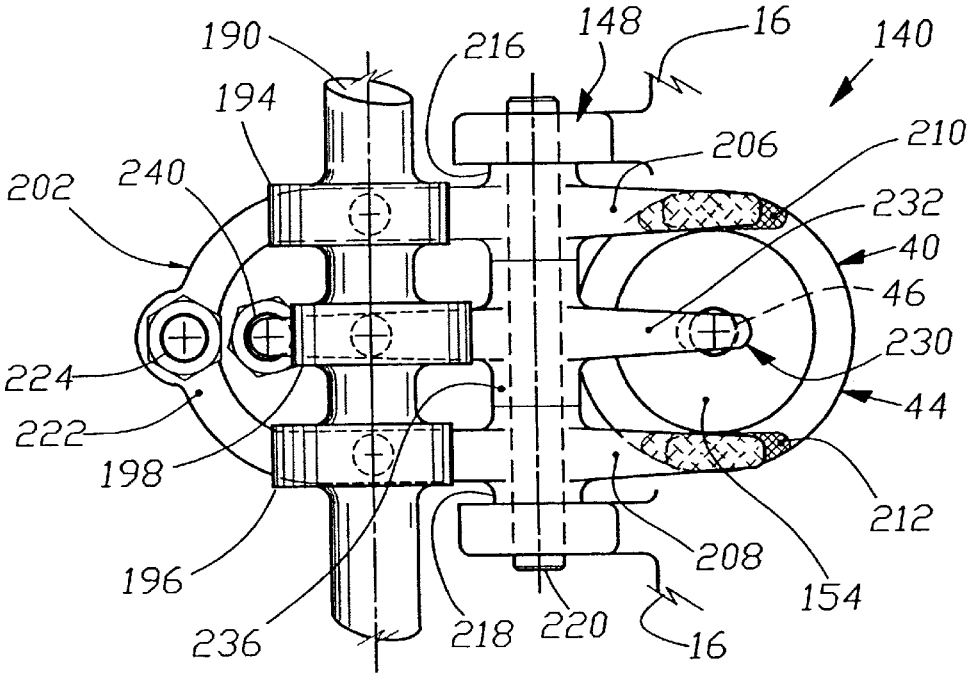
FIG. 4 is a schematic top plan view illustrating the relationship of a camshaft to rocker arms in the engine of FIG. 1.

The valve operating assembly 148 (FIG. 4) is effective to move the intake valve 44 and exhaust valve 46 against the influence of the intake valve spring 152 and the exhaust valve spring 170 (FIG. 3). The valve operating assembly 148 (FIG. 4) includes a rotatable camshaft 190. The camshaft 190 extends perpendicular to and is offset to one side of the central axis 54 of the intake and exhaust valves 44 and 46 (FIGS. 1 and 4). The camshaft 190 has a pair of intake valve actuation control lobes 194 and 196 (FIG. 4) which are fixedly connected with the camshaft. In addition, the camshaft 190 includes an exhaust valve actuation control lobe 198 which is also fixedly connected with the camshaft.

A single, generally U-shaped intake valve actuator 202 (FIG. 4) has a pair of generally parallel rocker arms 206 and 208 (FIGS. 3 and 4). The rocker arm 206 is disposed in engagement with the lobe 194 on the camshaft 190 and with an upstanding (as viewed in FIG. 3) end section 210 of the stem portion 68 of the intake valve 44. The rocker arm 208 engages the lobe 196 on the camshaft 190 and an upstanding end section 212 of the stem portion 68 of the intake valve 44.

The two parallel rocker arms 206 and 208 of the intake valve actuator 202 (FIG. 4) have coaxial mounting sections 216 and 218 which are rotatably supported on a rocker shaft 220. The rocker shaft 220 extends parallel to the camshaft 190. The rocker arms 206 and 208 are interconnected by an arcuate connector portion 222 of the intake valve actuator 202.

The connector portion 222 of the valve actuator is urged toward the camshaft 190 by a strong helical coil actuator biasing spring (not shown). The actuator biasing spring extends between the cylinder head 16 and the connector portion 222 of the intake valve actuator 202. The actuator biasing spring engages an underneath side of the valve actuator 202 opposite from the camshaft 190. A fastener 224 on the connector section 222 of the intake valve actuator 202 engages an actuator spring retainer.

The spring force applied against the connector section 222 of the intake valve actuator 202 by the actuator biasing spring firmly presses the arms 206 and 208 of the intake valve actuator against the valve actuation control lobes 194 and 196 on the camshaft 190. The actuator biasing spring is substantially stronger than and easily overcomes the combined effect of the intake valve spring 152 and exhaust valve spring 170. Therefore, whenever relatively small radius dwell portions of the lobes 194 and 196 on the camshaft 190 are in engagement with the rocker arms 206 and 208, the actuator biasing spring is effective to pivot the connector portion 222 about the rocker shaft 220 to open the intake valve 44.

An exhaust valve actuator 230 (FIG. 4) cooperates with the camshaft 190 to operate the exhaust valve 46 from the closed condition to the open condition against the influence of the exhaust valve spring 170 (FIG. 3). The exhaust valve actuator 230 includes a single rocker arm 232 which is disposed between and extends parallel to the rocker arms 206 and 208 of the intake valve actuator 202. The arm 232 of the exhaust valve actuator 230 has a mounting section 236 which is rotatably mounted on the rocker shaft 220.

The exhaust valve rocker arm 232 is rotatable about the rocker shaft 220 independently of rotation of the rocker arms 206 and 208 on the intake valve actuator 202 about the rocker shaft 220. Thus, the intake valve rocker arms 206 and 208 may be rotating in one direction about the rocker shaft 220 while the exhaust valve rocker arm 232 is rotating in the opposite direction about the rocker shaft.

A relatively strong, helical coil, actuator biasing spring (not shown) is provided at one end, that is the left end as viewed in FIG. 4, of the rocker arm 232 to bias the rocker arm 232 into engagement with the exhaust valve control lobe 198 on the camshaft 190. A suitable spring retainer (not shown) is connected with a fastener 240 to position the exhaust valve actuator biasing spring between the cylinder head 16 and the rocker arm 232. The exhaust valve actuator biasing spring is substantially stronger than and easily overcomes the exhaust valve spring 170.

Although one specific valve operating assembly 148 has been illustrated in FIG. 4, it is contemplated that a different valve operating assembly could be utilized if desired.

Operation

During operation of the engine 10, the camshaft 190 (FIG. 4) is continuously rotated to enable movement of the intake valve actuator 202 and exhaust valve actuator 230. The intake and exhaust valves 44 and 46 (FIG. 3) move between their open and closed conditions in a timed relationship with movement of the piston 22 (FIG. 1) in the cylinder block 14. When the intake valve 44 is in a closed condition, the rim portion 70 (FIG. 2) of the intake valve 44 is disposed in sealing engagement with the valve seat 72. When the exhaust valve 46 is closed, the rim portion 92 of the exhaust valve is disposed in sealing engagement with the valve seat 96.

When the intake valve 44 is to be operated from the closed condition to an open condition, the camshaft 190 (FIG. 4) rotates so as to engage the relatively small radius dwell portions of the intake valve actuation control lobes 194 and 196 with the intake valve rocker arms 206 and 208. This enables the actuator biasing spring for the intake valve actuator 202 to pivot the intake valve actuator about the rockshaft 220. As this occurs, the right (as viewed in FIG. 4) end portions of the intake valve rocker arms 206 and 208 move downward (as viewed in FIG. 3). Since the actuator biasing spring for the intake valve actuator 202 is substantially stronger than the combined intake valve spring 152 and exhaust valve spring 170, the intake valve 44 and exhaust valve 46 are easily moved downward (as viewed in FIG. 3) by the intake valve rocker arms 206 and 208. The exhaust valve 46 remains in the closed condition as it moves downward with the intake valve 44.

Downward movement of the intake valve rocker arms 206 and 208 applies force to the end sections 210 and 212 of stem portion 68 of the intake valve 44. This force moves the head end portion 66 (FIG. 2) of the intake valve 44 from its closed condition to its open condition against the influence of the intake valve spring 152 (FIG. 3). As the intake valve 44 moves from the closed condition to the open condition, the exhaust valve 46 moves with the intake valve against the influence of the exhaust valve spring 170.

When the intake valve 44 is in the open condition illustrated in FIG. 2, there is a relatively large annular opening 78 formed between the head end portion 66 of the intake valve 44 and the valve seat 72. Although the opening 78 has a relatively small vertical (as viewed in FIG. 2) extent, the annular opening 78 has a relatively large circumference. The large circumference of the annular opening 78 enables the air fuel mixture 26 to freely move into the combustion chamber 50 as the piston 22 moves downward (as viewed in FIG. 2).

The exhaust valve 46 moves with the intake valve 44 as the intake valve moves from its closed condition to its open condition. The exhaust valve 46 may be continuously maintained in its closed condition by the exhaust valve spring 170 (FIG. 3) during movement of the intake valve 44 from the closed condition to the open condition. This results in the exhaust valve 46 being stationary relative to the intake valve 44. Therefore, the stem portion 86 of the exhaust valve 46 moves away from the arm. 232 (FIG. 4) of the exhaust valve actuator 230, in the manner illustrated schematically in FIG. 3. Alternatively, the exhaust valve 46 may move toward its closed condition as the intake valve 44 is moving toward its open condition. This would result in the exhaust valve 46 moving upward (as viewed in FIG. 2) relative to the intake valve 44, as the intake valve moves downward.

When the intake valve 44 is to be returned to its closed position, rotation of the camshaft 190 moves the small radius dwell portions of the intake valve actuator control lobes 194 and 196 out of engagement with the intake valve rocker arms 206 and 208. The large radius nose portions of the intake valve actuator control lobes 194 and 196 move into engagement with the intake valve rocker arms 206 and 208. As this occurs, the rocker arms 206 and 208 move upward (as viewed in FIG. 3). The intake valve 44 then moves upward (as viewed in FIG. 3) under the influence of the intake valve spring 152 to again move the rim portion 70 (FIG. 2) of the intake valve 44 into sealing engagement with the valve seat 72.

The exhaust valve 46 is subsequently operated from the closed condition illustrated in FIG. 2 to its open condition. As the exhaust valve 46 moves from the closed condition to the open condition, the intake valve 44 remains stationary in sealing engagement with the valve seat 72. As the exhaust valve 46 moves to its open condition, it moves downward (as viewed in FIG. 2) relative to the intake valve 44 and cylinder head 16. This downward movement occurs against the influence of the exhaust valve spring 170 (FIG. 3).

To effect downward movement (as viewed in FIGS. 2 and 3) of the exhaust valve 46 against the influence of the exhaust valve spring 170 (FIG. 3), the exhaust valve actuator control lobe 198 (FIG. 4) on the camshaft 190 releases the exhaust valve rocker arm 232 for pivotal movement under the influence of the relatively strong actuator biasing spring connected with the fastener 240. This results in the exhaust valve rocker arm 232 being pivoted about the rockshaft 220 by the actuator biasing spring to move the exhaust valve rocker arm 230 downward (as viewed in FIG. 3). This applies force against the stem portion 86 of the exhaust valve 46 to move the exhaust valve relative to the intake valve 44.

As the exhaust valve 46 moves relative to the intake valve 44, the rim portion 92 (FIG. 2) on the head end portion 84 of the exhaust valve 46 moves away from the valve seat 96 on the intake valve 44. This results in the formation of an annular opening through which exhaust gases 32 move from the combustion chamber 50 into the recess 102 in the intake valve stem 68. The exhaust gases flow from the recess 102 through the passages 104 into the recess 108 in the valve stem portion 68 of the intake valve 44. The exhaust gases then flow through the openings 110 in the intake valve 44 and from the cylinder head 16 through the exhaust port 30.

When the exhaust valve 46 is to be closed, rotation of the camshaft 190 results in the exhaust valve actuator cam lobe 198 pivoting the exhaust valve rocker arm 232 to release the exhaust valve 46 for upward movement under the influence of the exhaust valve spring 170 (FIG. 3). As this occurs, the exhaust valve 46 moves from its open condition to its closed condition.

During operation of the engine 10, the intake valve stem portion 68 (FIGS. 2 and 3) and the exhaust valve stem portion 86 function as force application portions to which force is applied by the valve operating assembly 148 (FIG. 4). The intake valve seat 96 (FIG. 2) on the intake valve 44 functions as a force transmitting portion to transmit force to the exhaust valve 46. The rim portion 92 on the head end portion 84 of the exhaust valve 46 functions as a force application surface to which force is applied to the exhaust valve 46 by the intake valve 44.

In the embodiment of the combination intake and exhaust valve assembly 40 illustrated in FIG. 2, the exhaust valve seat 96 on the intake valve 44 and the rim portion 92 of the intake valve 40 cooperate to perform the dual functions of blocking gas flow from the combustion chamber 50 through the intake valve stem portion 68 and transmitting force from the intake valve 44 to the exhaust valve 46. However, if desired, surfaces separate from the exhaust valve seat 96 and rim portion 92 of the exhaust valve 46 could be utilized to transmit force to the exhaust valve 46.

Valve Operating Assembly—Second Embodiment

Figure 5:
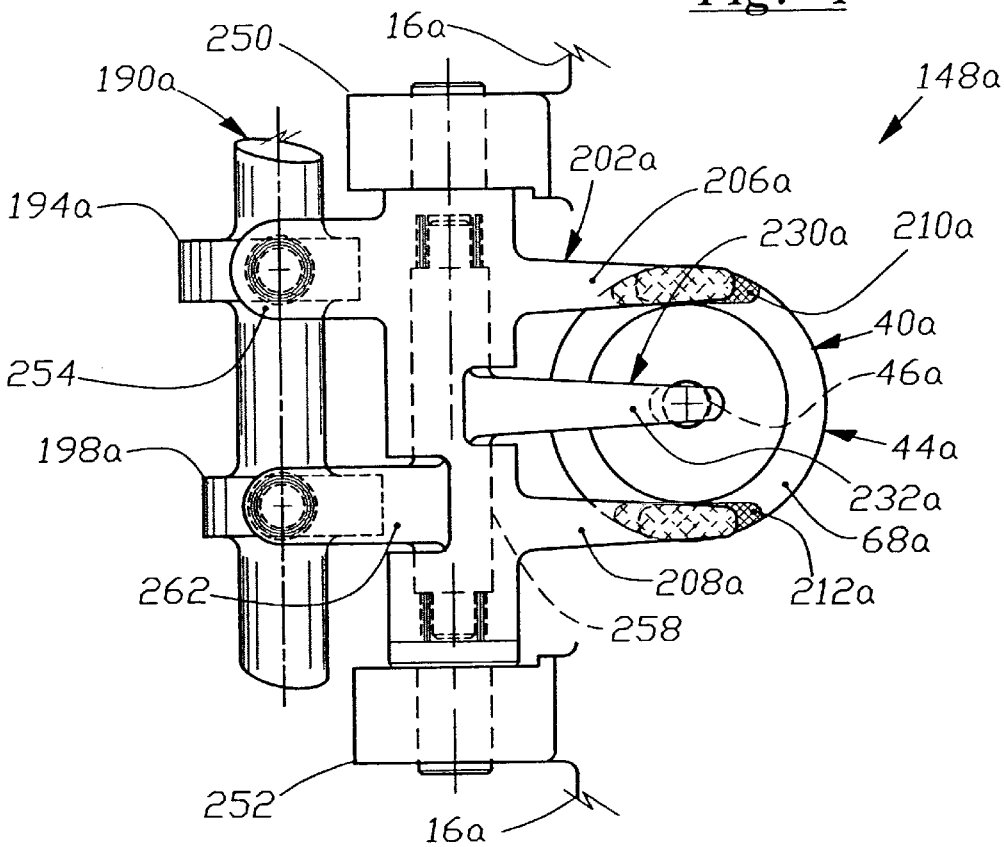
FIG. 5 is a top plan view, generally similar to FIG. 4, illustrating the relationship of a second embodiment of the camshaft and rocker arms in an engine, similar to the engine of FIG. 1.

In the embodiment of the invention illustrated in FIG. 4, the intake valve 44 and exhaust valve 46 are operated between their open and closed conditions under the influence of spring force applied against the intake valve rocker arms 206 and 208 and the exhaust valve rocker arm 232 by relatively strong actuator springs. In the embodiment of the invention illustrated in FIG. 5, force for operating the intake and exhaust valves between their open and closed conditions is transmitted directly from the camshaft lobes to the intake and exhaust valve rocker arms. Since the embodiment of the invention illustrated in FIG. 5 is generally similar to the embodiment of the invention illustrated in FIG. 4, similar numerals will be utilized to designate similar components, the suffix letter "a" being associated with the numerals of FIG. 5 to avoid confusion.

A valve operating assembly 148*a* (FIG. 5) is utilized to operate a combination intake and exhaust valve assembly 40*a* having the same construction and mode of operation as the combination intake and exhaust valve assembly 40 of FIGS. 1–3. The combination intake and exhaust valve assembly 40*a* includes an intake valve 44*a* and an exhaust valve 46*a*. A camshaft 190*a* has an intake valve actuation control lobe 194*a* which actuates an intake valve actuator 202*a*. In addition, the camshaft 190*a* has an exhaust valve actuation control lobe 198*a* which actuates an exhaust valve actuator 230*a*.

The intake valve actuator 202*a* is pivotally mounted on a pair of supports 250 and 252 connected with a cylinder head 16*a*. The intake valve actuator 202*a* includes a pair of parallel rocker arms 206*a* and 208*a* which engage upper end portions 210*a* and 212*a* of a stem portion 68*a* of the intake valve 44*a*. A rocker arm 254 of the intake valve actuator 202*a* is moved by the cam lobe 194*a* during rotation of the camshaft 190*a*.

The exhaust valve actuator 230*a* includes a support shaft 258 which is rotatably mounted at opposite ends on the intake valve actuator 202*a*. The support shaft 258 is fixedly connected with a rocker arm 232*a* and a rocker arm 262. The rocker arm 262 is moved by the exhaust valve actuator lobe 198*a* on the camshaft 190*a* during rotation of the camshaft.

Valve Operating Assembly—Third Embodiment

Figure 6:
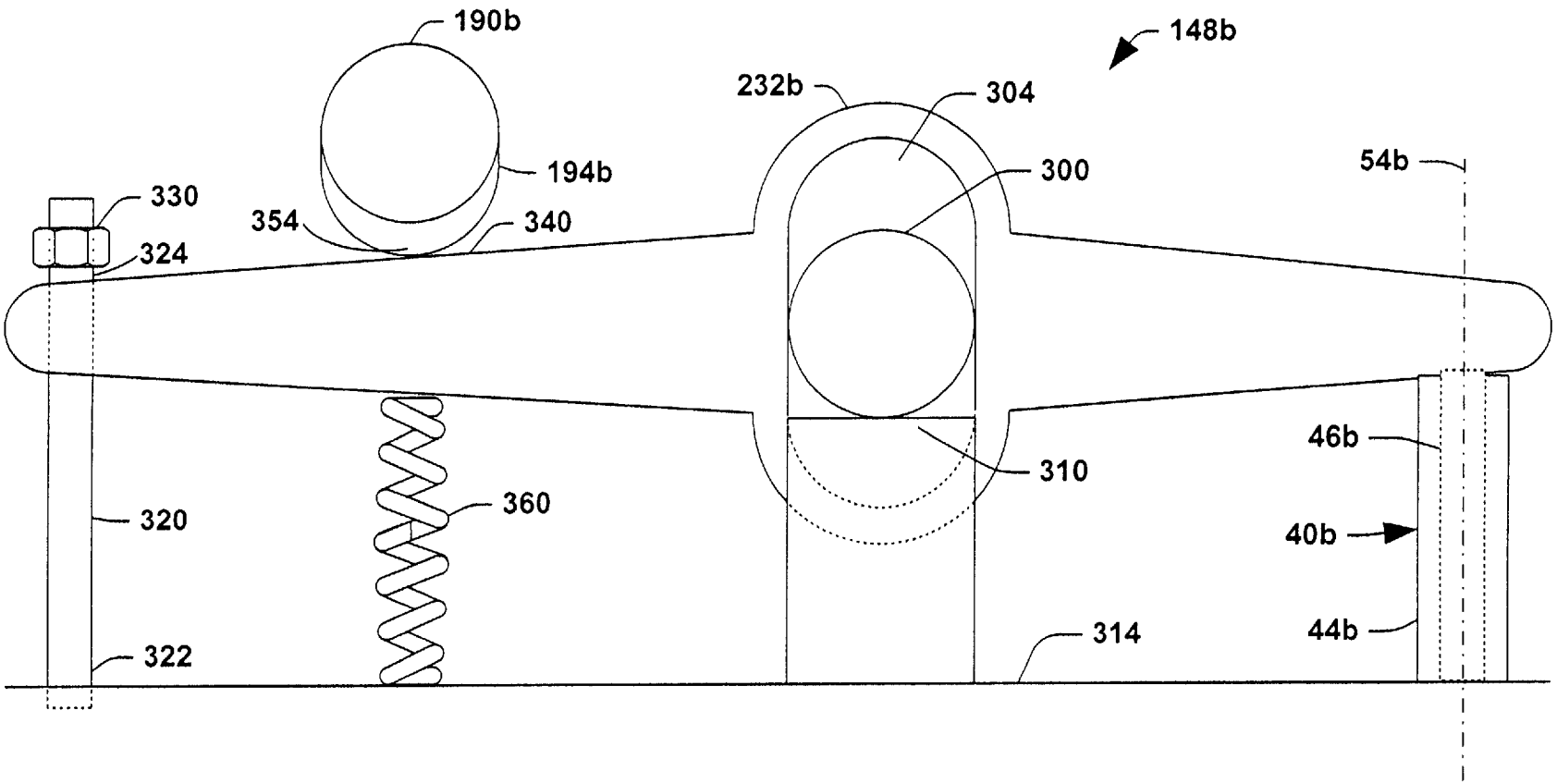
FIG. 6 is schematic diagram illustrating a side view of an alternative arrangement for a valve operating assembly according to an aspect of the present invention.

A side view of an alternative arrangement of an operating assembly 148*b* is shown in FIG. 6. As in FIG. 5, similar numerals are utilized to designate similar components, the suffix letter "b" being associated with the reference numerals in FIG. 6. The assembly 148*b* is utilized to operate a combination intake and exhaust valve assembly 40*b* having the same construction and mode of operation as the combination intake and exhaust valve assembly 40 depicted in FIGS. 1–3.

An exhaust valve rocker arm 232*b* is shown in operative association with an exhaust valve 46*b*. The exhaust valve 46*b* is coaxially arranged within an intake valve 44*b*. Rocker arm(s) for the intake valve 44*b* are not shown. The exhaust valve rocker arm 232*b* is operatively connected to a mounting shaft 300. In particular, the mounting shaft 300 passes through an oval shaped aperture 304 formed within the exhaust valve rocker arm 232*b*. The mounting shaft 300 is fixedly associated with a member 310 connected to the engine head 314. The oval shaped aperture 304 inhibits-horizontal, but allows vertical movement of the exhaust valve rocker arm 232*b* in a direction parallel to a central axis 54*b* of the exhaust 46*b* and intake 44*b* valves.

A portion of the exhaust valve rocker arm 232*b* situated opposite the valves 44*b*, 46*b* is supported by a spacer 320. The spacer 320 is juxtaposed between the exhaust valve rocker arm 232*b* and the engine head 314. One end 322 of the spacer 320 is connected to the engine head 314 while the other end 324 of the spacer 320 is secured to the exhaust valve rocker arm 232*b* by an adjustable fastener 330. The adjustable fastener 330 can be utilized to regulate the degree of contact between a surface 340 of the exhaust valve rocker arm 232*b* and a lobe 194*b* of a camshaft 190*b*. Also opposite the valves 44*b*, 46*b*, a spring 360 is interposed between the engine head 314 and the exhaust valve rocker arm 232*b*. The spring 360 is maintained in a compressed condition by the exhaust valve rocker arm 232*b* and, therefore, continually applies an upward biasing force against the exhaust valve rocker arm 232*b*. This biasing force serves to keep the surface 340 of the exhaust valve rocker arm 232*b* in contact with the lobe 194*b* of the camshaft 190*b*.

The spring 360 is designed such that its upward biasing force can be overcome by a downward force applied to the exhaust valve rocker arm 232*b* by a large radius dwell portion 354 of the lobe 194*b* on the camshaft 190*b*. In this manner, when the camshaft 190*b* rotates and the large radius dwell portion 354 of the lobe 194*b* contacts the surface 340 of the exhaust valve rocker arm 232*b*, the exhaust valve rocker arm is forced downward in a direction parallel to the central axis 54*b* of the valves 44*b*, 46*b*. As the camshaft 190*b* rotates further and a small radius dwell portion of the lobe 194*b* comes into contact with the surface 340 of the exhaust valve rocker arm 232*b*, the biasing force of the spring 360 forces the exhaust valve rocker arm 232*b* back up.

Depending upon the arrangement of the exhaust valve 46*b* within the intake valve 44*b* and more particularly the timed relationship between the opened and closed conditions of the valves, when the exhaust valve rocker arm 232*b* is forced downward, it may come into contact with and act upon the exhaust valve 46*b* causing the exhaust valve 46*b* to move to its open condition. Similarly, when the exhaust valve rocker arm 232*b* is forced back up, the exhaust valve 46*b* may return to its closed condition, again depending upon the orientation of the exhaust 46*b* and intake 44*b* valves.

It is to be appreciated, however, that depending upon factors, such as the timed relationships between the opened or closed conditions of the valves 44*b*, 46*b*, movement of the exhaust valve rocker arm 232*b* may or may not affect the condition of the exhaust valve 46*b*. If, for instance, the exhaust 46*b* and intake 44*b* valves move together and the valves are moved downward by an intake valve rocker arm (not shown), the exhaust valve rocker arm 232*b* may or may not come into contact with and have any affect upon the condition of the exhaust valve 46*b* when the exhaust valve rocker arm 232*b* is forced downward by a large radius dwell portion 354 of lobe 194*b*. In this manner, the movement and condition of the exhaust valve 46*b* is somewhat independent of the exhaust valve rocker arm 232*b*. As such, depending upon what is desired, the arrangement can be configured to move the valves 44*b*, 46*b* between their opened and closed conditions in any suitable timed relationships.

While this arrangement has been discussed with respect to an exhaust valve 46*b* and an exhaust valve rocker arm 232*b*, it is to be appreciated that the same arrangement may be applied to other valves and valve rocker arms, such as an intake valve and intake valve rocker arms.

CONCLUSION

The present invention relates to a new and improved combination intake and exhaust valve assembly 40 which is used in an internal combustion engine 10. The combination intake and exhaust valve assembly 40 includes an intake valve 44 and an exhaust valve 46 which are disposed in a coaxial relationship. A valve seat 72 for a head end portion of the intake valve 44 is disposed on the cylinder head 16. A valve seat 96 for the exhaust valve 46 is disposed on the intake valve 44.

When the intake valve 44 is operated from a closed condition to an open condition, the intake and exhaust valves 44 and 46 may be moved together. However, the exhaust valve 46 remains in a closed condition. If desired, the exhaust valve 46 could be moved toward the closed condition as the intake valve 44 moves toward the open condition. The intake valve is subsequently moved from the open condition to the closed condition while the exhaust valve 46 remains in a closed condition and moves with the intake valve. If desired, the exhaust valve 46 could be moved toward the open condition as the intake valve 44 moves toward the closed condition.

After an air fuel mixture has been burned in the combustion chamber 50, the exhaust valve 46 is moved to the open condition. As the exhaust valve 46 begins to move away from the closed condition, a head end portion 84 of the exhaust valve moves away from a valve seat 96 disposed on the intake valve. Guides for movement of the exhaust valve relative to the intake valve may be mounted on the intake valve.

The present invention includes a plurality of features which may be used separately or in combination with each other. Combinations of features which are different than the combinations described herein may be used. For example, the combination intake and exhaust valve assembly 40 may be actuated by valve operating assemblies having constructions which are different than the constructions of the valve operating assemblies 148, 148*a* and 148*b*. As another example, the valve 44 could be used to control gas flow from the combustion chamber 50 and the valve 46 could be used to control gas flow to the combustion chamber.

Having described the invention, the following is claimed:

1. A combination intake and exhaust valve assembly for use in controlling flow to and from a combustion chamber of an internal combustion engine, said valve assembly comprising an intake valve having a head portion that includes an annular rim portion movable into and out of engagement with an annular intake valve seat defined by a portion of a cylinder head of the internal combustion engine that at least partially overlaps said annular rim portion of said intake valve to control flow into the combustion chamber of the internal combustion engine during operation of the internal combustion engine and an annular exhaust valve seat circumscribed by said annular rim portion and at least partially defining an exhaust valve seat, and an exhaust valve having an annular rim portion movable into and out of engagement with said exhaust valve seat in said intake valve to control flow from the combustion chamber of the internal combustion engine during operation of the internal combustion engine.

2. A valve assembly as set forth in claim 1 wherein said intake valve includes a head portion and a stem portion which is connected with said head portion, said annular rim portion of said intake valve and said annular exhaust valve seat being disposed on said head portion of said intake valve, said exhaust valve includes a head portion and a stem portion which is connected with said head portion of said exhaust valve, said annular rim portion of said exhaust valve being disposed on said head portion of said exhaust valve.

3. A valve assembly as set forth in claim 2 wherein said stem portions of said intake and exhaust valves are disposed in a coaxial relationship.

4. A valve assembly as set forth in claim 3 wherein said stem portion of said exhaust valve is at least partially enclosed by said stem portion of said intake valve.

5. A valve assembly as set forth in claim 3 wherein said intake valve includes an exhaust valve guide disposed in said stem portion of said intake valve, said stem portion of said exhaust valve extends through said exhaust valve guide, said exhaust valve guide has a guide surface which engages said stem portion of said exhaust valve to guide movement of said exhaust valve relative to said intake valve during operation of the internal combustion engine.

6. A valve assembly as set forth in claim 2 wherein said stem portion of said intake valve includes a passage through which flow is conducted from said exhaust valve seat during operation of the internal combustion engine.

7. A valve assembly as set forth in claim 6 further including an exhaust valve guide disposed in the passage through which flow is conducted from said exhaust valve seat during operation of the internal combustion engine, said exhaust valve guide having surface means for guiding movement of said exhaust valve relative to said intake valve.

8. A valve assembly as set forth in claim 2 further including an intake valve spring extending around said stem portion of said intake valve and connected with said stem portion of said intake valve to urge said rim portion of said intake valve toward the intake valve seat in the internal combustion engine, and an exhaust valve spring extending around said stem portion of said exhaust valve and connected with said stem portion of said exhaust valve to urge said rim portion of said exhaust valve toward said exhaust valve seat in said intake valve.

9. A valve assembly as set forth in claim 8 wherein said intake valve spring and said exhaust valve spring have coincident central axes which are coincident with central axes of said stem portions of said intake and exhaust valves.

10. A valve assembly as set forth in claim 8 wherein said intake valve spring extends around at least a portion of said exhaust valve spring.

11. A valve assembly as set forth in claim 2 wherein said stem portion of said intake valve includes a plurality of ports through which flow from said exhaust valve seat is conducted during operation of the internal combustion engine.

12. A valve assembly as set forth in claim 2 wherein said stem portion of said intake valve includes a force application surface to which force is transmitted during operation the internal combustion engine to move said intake valve during operation of the internal combustion engine, said exhaust valve seat in said intake valve being effective to transmit force applied to said force application surface to move said exhaust valve during operation of the internal combustion engine.

13. A combination intake and exhaust valve assembly for use in an internal combustion engine, said valve assembly comprising an intake valve having an intake valve force application portion to which force is applied to effect movement of said intake valve from a closed position blocking flow to a combustion chamber of the internal combustion engine through engagement of an annular rim portion of a head portion of said intake valve with an intake valve seat defined by a portion of a cylinder head of the internal combustion engine that at least partially overlaps said annular rim portion of said intake valve to an open position enabling flow to the combustion chamber of the internal combustion engine during operation of the internal combustion engine, and an exhaust valve having a first force application portion to which force is applied to effect movement of said exhaust valve from a closed position blocking flow from the combustion chamber of the internal combustion engine to an open position enabling flow from the combustion engine during operation of the internal combustion engine, said intake valve including a force transmitting portion which engages a second force application portion on said exhaust valve to transmit force from said intake valve to said exhaust valve and move said exhaust valve with said intake valve during movement of said intake valve from the closed position to the open position with said exhaust valve in the closed position.

14. A valve assembly as set forth in claim 13 wherein said force transmitting portion of said intake valve is engage by said second force application portion on said exhaust valve when said exhaust valve is in the closed position, said second force application portion on said exhaust valve being movable away from said force transmitting portion on said intake valve under the influence of force applied to said first force application portion on said exhaust valve during movement of said exhaust valve from the closed position to the open position.

15. A valve assembly as set forth in claim 13 further including an intake valve spring connected with said intake valve to effect movement of said intake valve from the open position to the closed position during operation of the internal combustion engine, and an exhaust valve spring connected with said exhaust valve to effect movement of said exhaust valve from the open position to the closed position during operation of the internal combustion engine, said intake and exhaust valve springs being disposed in a coaxial relationship with said intake valve spring extending around at least a portion of said exhaust valve spring.

16. A valve assembly as set forth in claim 13 wherein said intake valve includes a passage which is blocked when said exhaust valve is in the closed position and is open when said exhaust valve is in the open position to enable flow to be conducted from the combustion chamber through said passage when said exhaust valve is in the open position.

17. A valve assembly as set forth in claim 13 further including an exhaust valve guide mounted on said intake valve, said exhaust valve guide engages said exhaust valve to guide movement of said exhaust valve between the open and closed positions.

18. A valve assembly as set forth in claim 17 wherein said exhaust valve guide moves with said intake valve during movement of said intake valve between the open and closed positions.

19. A valve assembly as set forth in claim 13 wherein said intake valve includes a tubular valve stem, said exhaust valve includes a valve stem which is disposed in a passage in said tubular intake valve stem, said force application portion on said intake valve being disposed on said tubular intake valve stem, said first force application portion on said exhaust valve being disposed on said exhaust valve stem.

20. An internal combustion engine comprising:

an engine block defining a cylinder;

a cylinder head connected with said block;

said cylinder head having an intake passage communicating with the cylinder for directing intake air into the cylinder, and an intake valve seat;

an intake valve supported by said cylinder head for reciprocating movement, said intake valve having a head including an annular rim portion;

said intake valve being movable relative to said cylinder head between a closed condition in which said annular rim portion of said intake valve head is in sealing engagement with said intake valve seat defined by a portion of said cylinder head that at least partially overlaps said annular rim portion to block fluid flow through said intake passage, and an open condition in which said intake valve head is spaced from said intake valve seat to enable fluid flow through said intake passage into said cylinder;

said cylinder head having an exhaust passage communicating with the cylinder for directing exhaust fluid out of the cylinder;

an exhaust valve having a head;

said intake valve having an exhaust valve seat;

said exhaust valve being movable relative to said cylinder head between a closed condition in which said exhaust valve head is in sealing engagement with said exhaust valve seat on said intake valve to block fluid flow through said exhaust passage, and an open condition in which said exhaust valve head is spaced apart from said exhaust valve seat on said intake valve to enable fluid flow out of said cylinder through said exhaust passage.

21. An engine as set forth in claim 20 wherein said intake valve is coaxial with said exhaust valve.

22. An engine as set forth in claim 20 wherein said exhaust valve head is disposed radially within said intake valve head.

23. An engine as set forth in claim 22 wherein said intake valve head has an annular configuration extending around said exhaust valve head.

24. An internal combustion engine comprising:

an engine block defining a cylinder;

a cylinder head connected with said block;

said cylinder head having an intake passage communicating with the cylinder for directing intake air into the cylinder and an exhaust passage communicating with the cylinder for directing exhaust fluid out of the cylinder;

an intake valve movable relative to said cylinder head between a closed condition in which an annular rim portion of a head of said intake valve engages a portion of said cylinder head that at least partially overlaps said annular rim portion and blocks fluid flow through said intake passage and an open condition to enable fluid flow through said intake passage into said cylinder;

an exhaust valve movable relative to said cylinder head between a closed condition in which said exhaust valve blocks fluid flow through said exhaust passage and an open condition to enable fluid flow out of said cylinder through said exhaust passage;

said intake valve and said exhaust valve being supported on said cylinder head for reciprocating movement along a common axis, said intake valve and said exhaust valve being coaxial with each other.

* * * * *